US006927348B1

(12) United States Patent
Schmidt et al.

(10) Patent No.: US 6,927,348 B1
(45) Date of Patent: Aug. 9, 2005

(54) ROTARY CONTROL SWITCH ASSEMBLY

(75) Inventors: Robert M. Schmidt, Livonia, MI (US); Mark G. Feldman, Farmington Hills, MI (US); Charles Bruce Banter, Northville, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/880,313

(22) Filed: Jun. 29, 2004

(51) Int. Cl.[7] ..... H01H 19/00

(52) U.S. Cl. ..... 200/5 R; 200/517; 200/568; 200/336

(58) Field of Search ..... 200/4, 5 R, 11 R, 200/17 R, 18, 517, 336, 564, 568, 571, 316

(56) References Cited

U.S. PATENT DOCUMENTS 4,618,744 A 10/1986 Pope et al.
5,087,798 A 2/1992 Rohde et al.
5,401,927 A * 3/1995 Lundell et al. ..... 200/314
5,463,692 A * 10/1995 Fackler ..... 381/324
5,493,082 A 2/1996 Bloch et al.
5,665,946 A * 9/1997 Nishijima et al. ..... 200/4
5,743,380 A 4/1998 Gauker
6,031,190 A * 2/2000 Tokuda et al. ..... 200/11 R
6,046,415 A 4/2000 Briski
6,084,189 A * 7/2000 Menche et al. ..... 200/315
6,713,701 B2 * 3/2004 Miyako et al. ..... 200/517
6,797,907 B1 * 9/2004 Meagher et al. ..... 200/564

* cited by examiner

*Primary Examiner*—Michael A. Friedhofer
(74) *Attorney, Agent, or Firm*—MacMillan, Sobanski & Todd, LLC

(57) ABSTRACT

A switch apparatus for a vehicle includes a circuit board including at least one circuit having a first contact and a second contact. A knob is rotatably mounted relative to the circuit board. The knob has at least one cam extending therefrom. At least one switch corresponds respectively to the at least one circuit and has a switch contact. The switch contact is linearly movable to an engaged position in which the switch contact contacts the first contact and the second contact of the respective at least one circuit, such that the first contact and the second contact are electrically connected. The knob is rotatably movable such that the at least one cam moves the at least one switch contact into the engaged position.

19 Claims, 4 Drawing Sheets

ROTARY CONTROL SWITCH ASSEMBLY

BACKGROUND OF THE INVENTION

This invention relates in general to switch assemblies, and, more specifically, to switch assemblies including one or more rotary control switches.

Rotary control switches are increasingly common in vehicle switch assemblies, such as switch assemblies for the climate control or audio systems of a vehicle. Rotary control knobs are generally mounted for rotation to a switch bezel. A rotary shaft of the conventional rotary switch cell extends outwardly from a circuit board through the switch bezel, such that the rotary shaft extends into a rearward side of the rotary control knob when the knob is mounted to the switch bezel. It is cumbersome to mount the rotary shaft to a circuit board and then mount the bezel to the circuit board, such that the rotary shaft extends in the precise position desired to mount the knob to the bezel and rotary shaft. Additionally, when multiple rotary control switches are to be mounted to a single bezel and/or circuit board, the difficulty in alignment of all rotary control switches and other desired switch devices relative to one another and to the respective rotary shafts, circuits, and bezels becomes even more complex. Therefore, it would be desirable to provide a rotary control switch that is less cumbersome to mount within a switch assembly while achieving the desired accuracy in placement of the rotary control switch knob relative to the various components of the switch assembly.

BRIEF SUMMARY OF THE INVENTION

This invention relates to a switch apparatus for a vehicle including a circuit board including at least one circuit having a first contact and a second contact. A knob is rotatably mounted relative to the circuit board. The knob has at least one cam extending therefrom. At least one switch corresponds respectively to the at least one circuit and has a switch contact. The switch contact is linearly movable to an engaged position in which the switch contact contacts the first contact and the second contact of the respective at least one circuit, such that the first contact and the second contact are electrically connected. The knob is rotatably movable such that the at least one cam moves the at least one switch contact into the engaged position.

In a further embodiment, the vehicle switch apparatus includes a circuit board including a plurality of circuits. Each of the plurality of circuits has a first contact and a second contact. An elastomeric pad includes a plurality of dome switches extending outwardly therefrom. Each of the plurality of dome switches corresponds to a respective one of the plurality of circuits. The plurality of dome switches each have a switch contact. Each of the switch contacts is linearly movable to an engaged position in which each of the switch contacts engages the first contact and the second contact of the respective circuit, such that the first contact and the second contact are electrically connected, and from a disengaged position in which the switch contact is spaced apart from at least one of the first contact and the second contact of the respective circuit. A bezel having a mounting apparatus is provided, and a knob is rotatably mounted to the bezel. The knob has a plurality of cams extending therefrom. Each of the plurality of cams corresponds to a respective one of the plurality of circuits. The knob is rotatably movable such that one of the plurality of cams is adapted to move one of the plurality of switch contacts into the engaged position while the other of the plurality of switch contacts remains in the disengaged position.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
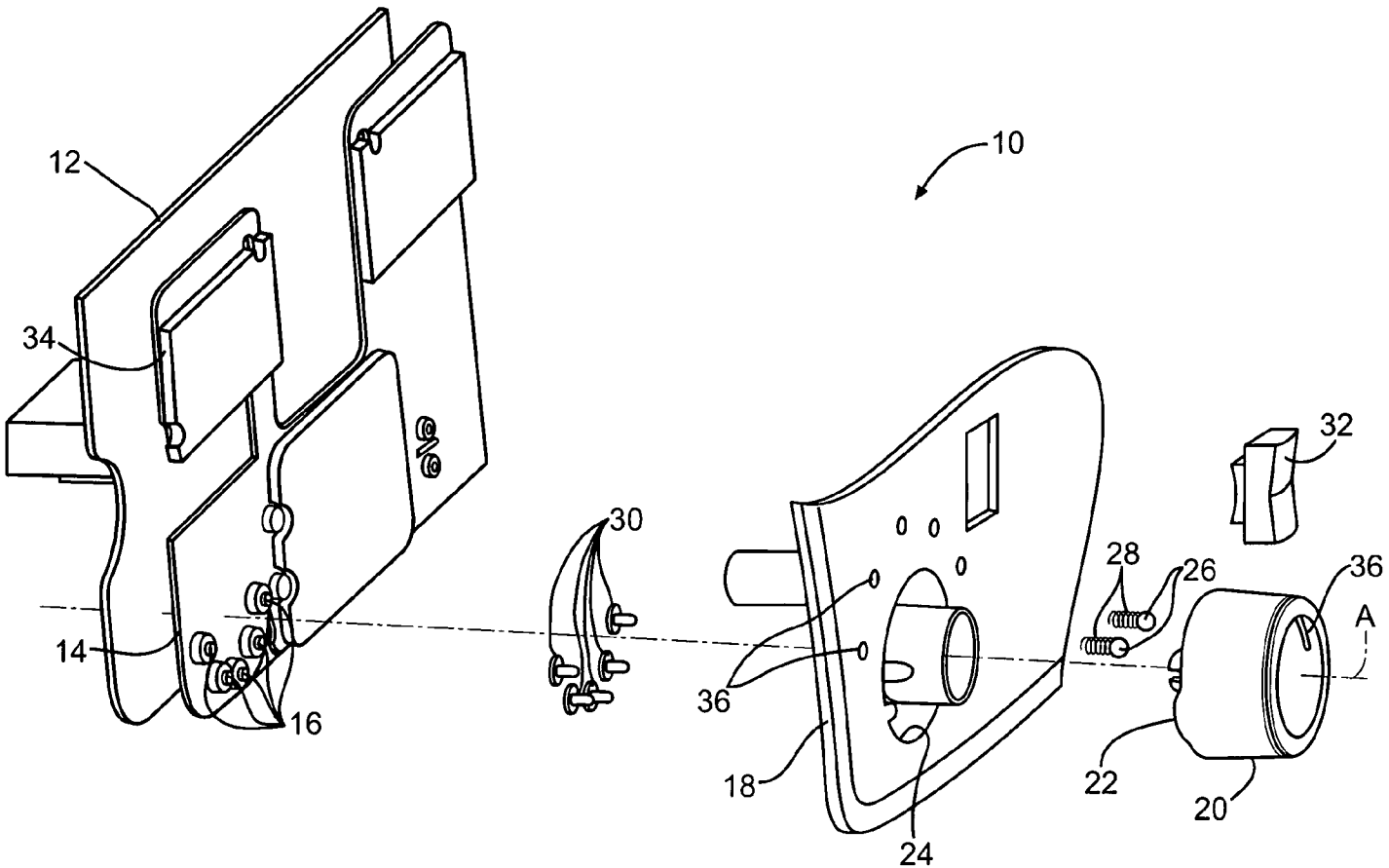
FIG. 1 is an exploded perspective view of a switch assembly having a switch apparatus in accordance with the present invention.

Referring now to the drawings, there is illustrated in FIG. 1 a switch assembly, indicated generally at 10, in accordance with the present invention. The switch assembly 10 includes a circuit board 12. An elastomeric pad 14 may be disposed on a portion of the circuit board 14, although such is not required. The elastomeric pad 14 may contain at least one switch 16, although such is not required. The at least one switch 16 may be positioned to extend from the circuit board 12 and may be formed separate from the elastomeric pad 14. A bezel 18 may be provided on the circuit board 12 and elastomeric pad 14. A knob 20 having a cam 22 may be rotatably mounted relative to the circuit board 12 for rotation about an axis A, and in a preferred embodiment, is mounted to the bezel 18. The bezel 18 may include a mounting apparatus 24 to facilitate mounting the knob 20 to the bezel 18, such that the knob 20 and the at least one switch 16 are communicably connected as will be described herein. In a preferred embodiment, at least one detent ball 26 and at least one detent spring 28 may be provided within the mounting apparatus 24 to facilitate the rotary motion of the knob 20 relative to the bezel 18 and the positioning of the knob 20 relative to the at least one switch 16, as will be described herein. In a preferred embodiment, at least one transfer pin 30 may be provided between the at least one switch 16 and the knob 20, such that the cam 22 of the knob 20 may contact one of the at least one transfer pin 30 to engage one of the at least one switch 16. The circuit board 12, the at least one switch 16, and the knob 20 preferably form a switch apparatus 31 in accordance with the present invention. The switch assembly 10 may additionally include various conventional switch apparatus, such as the switch apparatus 32. The switch apparatus 32 may also include various switches, similar to the at least one switch 16, that may be engaged by various knob and/or cam mechanisms.

Figure 2:
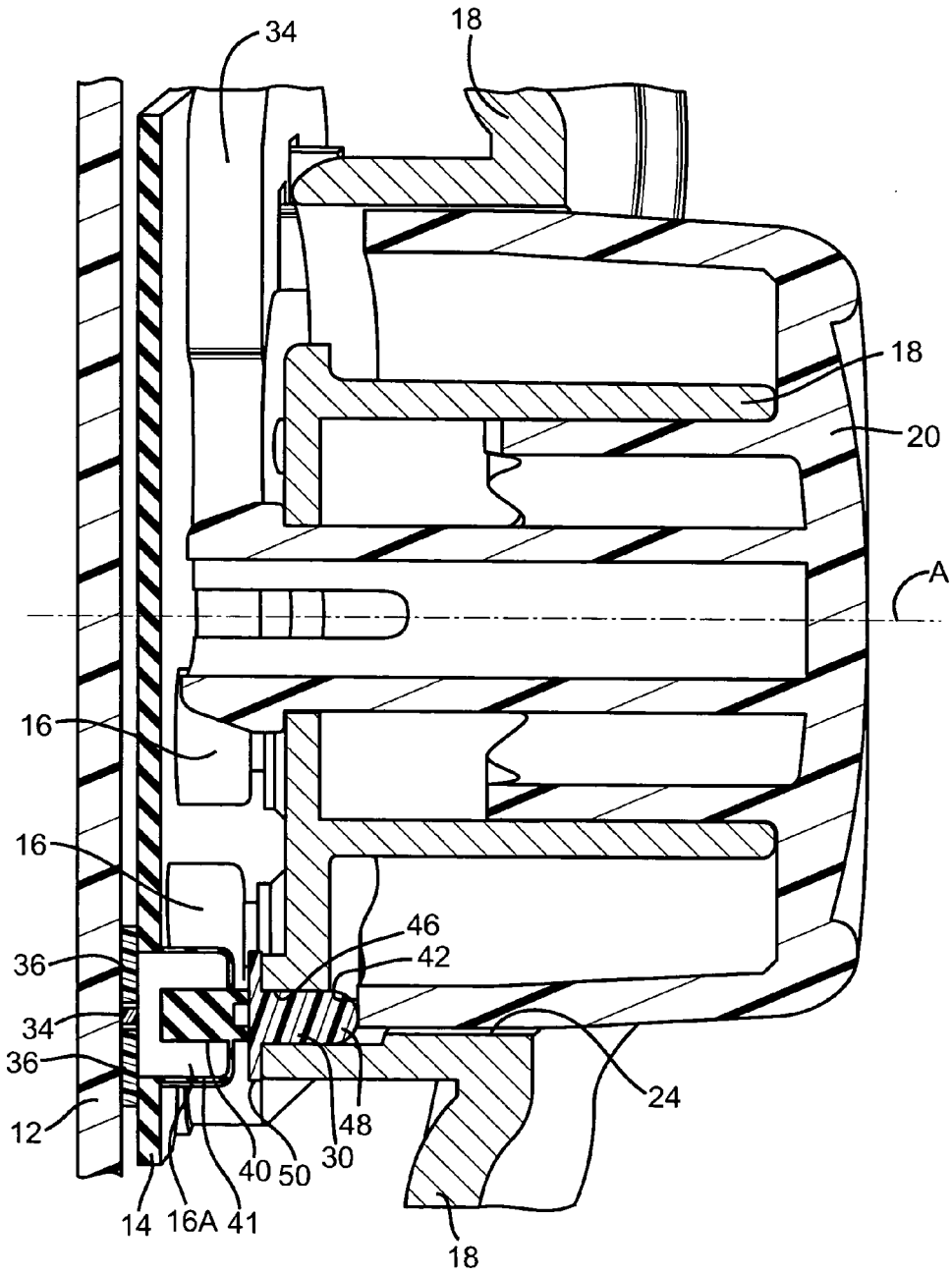
FIG. 2 is a cross-sectional view of the switch apparatus shown in FIG. 1 in a disengaged position.

The circuit board 12 may be a conventional printed circuit board. The circuit board 12 may include conductive traces for implementing conventional switch functions. The circuit board 12 may include a first contact 34 and a second contact 36, respectively, for each of the at least one switch 16, as shown in FIG. 2. The circuit board 12 may include various contacts or conductive traces for implementing desired switch functions, as will be described herein in accordance with the present invention.

The elastomeric pad 14 may be a conventional elastomer pad suitable for use with conventional switches, such as dome switches or membrane switches. The elastomeric pad 14 may cover a portion of the circuit board 12 having the contacts for the at least one switch 16. It will be appreciated that the elastomeric pad 14 may cover an entire surface of the circuit board 12 or any portion thereof. It will also be appreciated that the elastomeric pad 14 may also be disposed between the circuit board 12 and other conventional switch apparatus, such as the switch apparatus 32, and may function conventionally with such switch apparatus. At least a portion 36 of the elastomeric pad 14 may transmit light therethrough or be adapted to be a light pipe. At least a portion of the elastomeric pad 14 may filter light therethrough. For example, a portion of the elastomeric pad 14 may transmit light therethrough and may be a translucent color, such that the light transferred or filtered therethrough is tinted to a desired color. It will be appreciated that at least a portion of the elastomeric pad 14 may be comprised of various layers of elastomer, each layer having various light transmission and/or filtering capabilities. The transmission or filtration of light through the elastomeric pad 14 may be desirable to illuminate an indicator 38 on a knob or the bezel 18 disposed on the elastomeric pad 14.

Figure 3:
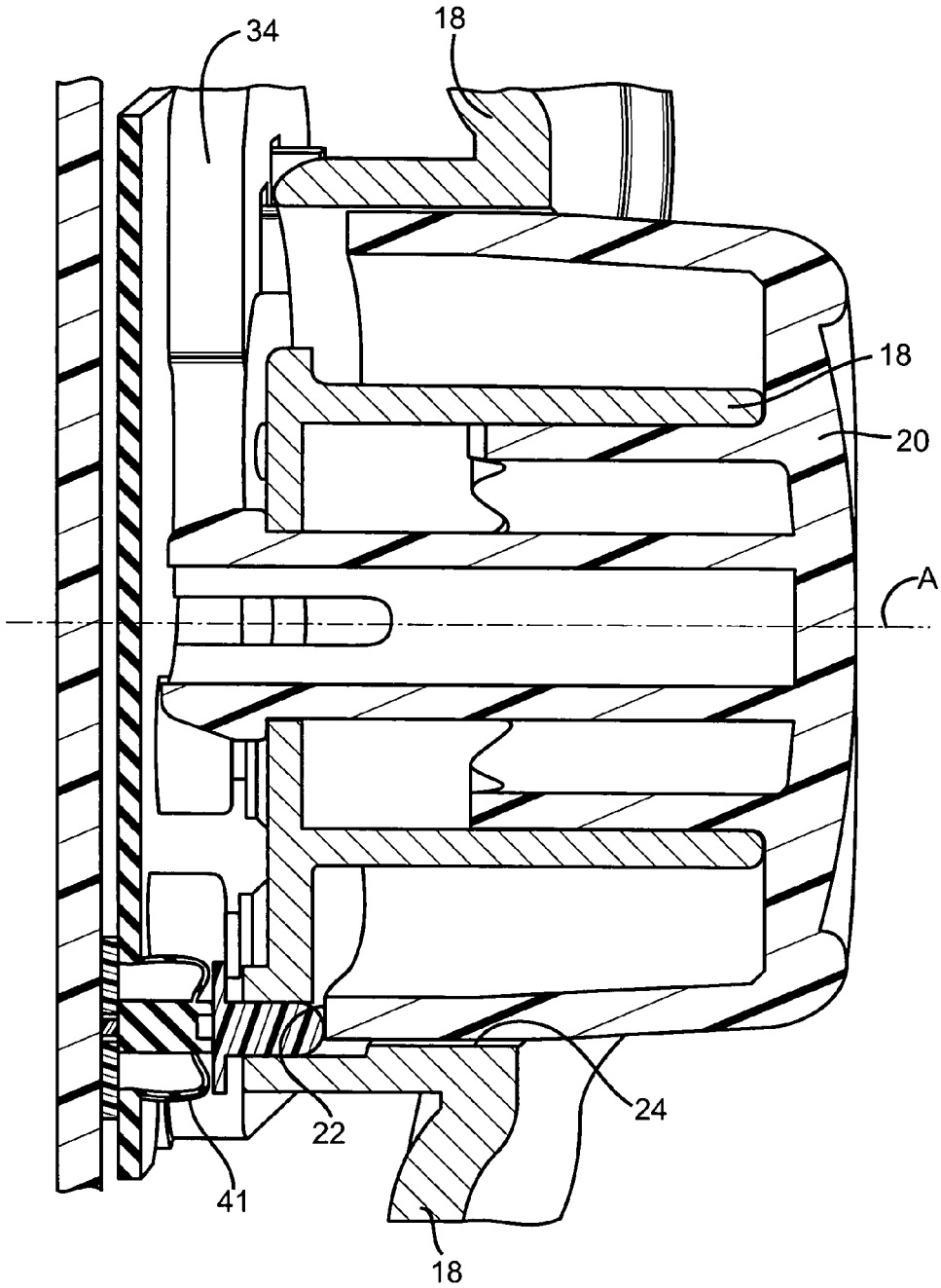
FIG. 3 is a cross-sectional view of the switch apparatus shown in FIGS. 1 and 2 in an engaged position.

As illustrated, the at least one switch 16 may be a plurality of dome switches or membrane switches molded within the elastomeric pad 14. However, it will be appreciated that each of the at least one switch 16 may be any conventional switch apparatus having a switch contact 40 that is linearly movable generally parallel to the axis A from a disengaged position in which the switch contact 40 is spaced apart from at least one of the first contact 34 and second contact 36 of the circuit board 12, as shown in FIG. 2, to an engaged position in which the switch contact 40 contacts the first contact 34 and the second contact 36 of the circuit board 12, as shown in FIG. 3. The switch contact 40 may remain in the disengaged position until the cam 22 moves the switch contact 40 into the engaged position. The switch contact 40 of the at least one switch 16 may be a contact dome of a dome or membrane switch, although such is not required. Preferably, the at least one switch 16 may be a generally hollow protrusion that flexes and functions as a spring to permit a switch contact 40 supported by the flexible protrusion to be spaced apart from the circuit board 12 and be able to be moved into contact with the circuit board 12, as will be described herein. The at least one switch 16 may be encapsulated between the circuit board 12 and the elastomeric pad 14, although such is not required. The elastomeric pad 14 may form a switch housing 41 to support the switch contact 40, although such is not required. The switch housing 41 may be any conventional switch housing adapted to support the switch contact 40. The cam 22 of the knob 20 or the at least one transfer pin 30 may directly contact the at least one switch 16.

The bezel 18 may be disposed on the circuit board 12 and/or the elastomeric pad 14. The bezel 18 may be made of any conventional material for switch assembly or instrument panel bezels. The bezel 18 may include various other apertures or flanges to facilitate the mounting of the bezel 18 to the circuit board 12 and/or elastomeric pad 14. The bezel 18 may also include various other apertures or flanges to facilitate the mounting of the switch assembly 31 or other switch assemblies, such as the switch assembly 32.

The knob 20 includes the cam 22 that extends outwardly toward the at least one switch 16 when the knob 20 is rotatably mounted relative to the circuit board 12. As illustrated in FIGS. 1 and 3, the cam 22 may be provided on a peripheral edge 42 of the knob 20, although such is not required. It will be appreciated that the cam 22 may extend from any portion of the knob 20, and may be any shape capable of engaging the switch contact 38 of the at least one switch 16. The cam 22 may be shaped to correspond to the layout of the at least one switch 16, such that regardless of the rotary position of the knob 20 relative to the at least one switch 16, the cam 22 engages only one of the at least one switch 16. Alternatively, It will be appreciated that the knob 20 may include a plurality of cams, similar to the cam 22. Preferably, the cam 22 or plurality of cams may cooperate with the at least one switch 16, such that the cam 22 or one of the plurality of cams moves one of the switch contacts 40 of the at least one switch 16 into the engaged position while the other switch contacts 40 of the at least one switch 16 are not in the engaged position. Alternatively, the cam 22 or plurality of cams may cooperate with the at least one switch 16, such that the cam 22 or one of the plurality of cams moves one of the switch contacts 40 of the at least one switch 16 into the engaged position before releasing another of the switch contact 40 of the at least one switch 16 from the engaged position.

Figure 4:
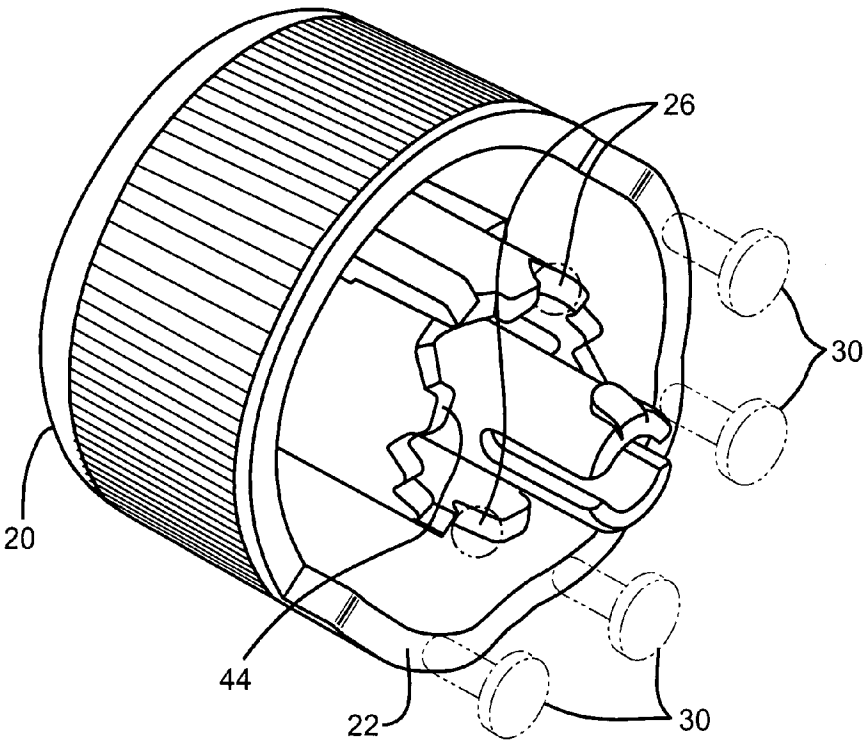
FIG. 4 is a rear perspective view of the knob of the switch apparatus shown in FIGS. 1 through 3.

The mounting apparatus 24 of the bezel 18 may include various apertures and flanges to facilitate the rotary mounting of the knob 20 to the bezel. The at least one switch 16 may extend through the mounting apparatus 24 of the bezel 18 to contact the knob 20. Additionally, or alternatively, the knob 20 may extend through mounting apparatus 24 to contact the at least one switch 16. The at least one detent ball 26 and at least one detent spring 28 may be disposed within the mounting apparatus 24 and may cooperate with the knob 20 to facilitate the rotary positioning of the knob 20 relative to the at least one switch 16. Preferably, the bezel 18, the knob 20, the at least one detent ball 26, and the at least one detent spring 28 cooperate to urge the knob into a plurality of rotary positions relative to the at least one switch 16, such that when the knob is in one of the plurality of positions the at least one cam 22 is positioned to move one of the switch contacts 40 of the at least one switch 16 into the engaged position. The knob 20 may include at least one detent cam 44, as shown in FIG. 4, to cooperate with the at least one detent ball 26 and the at least one detent spring 28 to urge the knob into the plurality of rotary positions, although such is not required.

The at least one transfer pin 30 may be disposed between the at least one switch 16 or a portion of the elastomeric pad 14 disposed over the at least one switch 16 and the knob 20, such that the cam 22 of the knob 20 engages the at least one transfer pin 30. In a preferred embodiment, the at least one transfer pin 30 is shaped to fit into a recess 46 in the bezel 18. A first portion 48 of the at least one transfer pin 30 may be engaged by the cam 22 of the knob 20. A second portion 50 of the at least one transfer pin 30 is disposed adjacent the at least one switch 16. The second portion 50 of the at least one transfer pin 30 and the at least one switch 16 preferably have a relatively large contact area therebetween. Thus, the accuracy in the alignment between the assembly of the bezel 18, knob 20, and at least one transfer pin 30 and the at least one switch 16 is not as critical to ensure that the at least one transfer pin 30 will make contact with the at least one switch 16 to move the at least one switch 16 to the engaged position. In an alternate embodiment, the at least one transfer pin 30 is formed integral to the elastomeric pad 14. It will be appreciated that the at least one transfer pin 30 may be adapted to be a detent to position the knob 20 relative to the bezel 18 or may cooperate with other portions of the knob 20 and mounting apparatus 24 to be a detent to position the knob 20 relative to the bezel 18.

Referring now to FIG. 2, the operation of the switch apparatus 31 will now be described. As shown, the peripheral edge 42 of the knob 20 is adjacent a desired transfer pin 30*a* of the at least one transfer pin 30. The desired transfer pin 30*a* is disposed adjacent the switch contact 40 of a desired switch 16*a* of the at least one switch 16. The knob 20 is positioned about the axis A such that the cam 22 is not in contact with the desired transfer pin 30*a*. Thus, as illustrated, the desired switch 16*a* is in the disengaged position in which the switch contact 40 of the desired switch 16*a* is spaced apart from both of the first contact 34 and the second contact 36. It will be appreciated that portions of the knob 20 other than the cam 22, may be in contact with the transfer pin 30*a*. However, such contact with portions of the knob 20 other than the cam 22 do not move the transfer pin 30*a* into contact with both the first contact 34 and the second contact 36.

In FIG. 3, the knob 20 has been rotated about the axis A, such that the cam 22 is in contact with the desired transfer pin 30*a*. The cam 22 extends further leftward, as illustrated in FIG. 3, than the non-cam portions of the knob 20. The cam 22 has moved the desired transfer pin 30*a* toward the desired switch 16*a*. The switch contact 40 of the desired switch 16*a* moves into contact with the circuit board 12, such that the switch contact 40 electrically connects the first contact 34 to the second contact 36. The switch housing 41 may be slightly deformed by the contact of the cam 22 to allow the switch contact 40 to move toward the circuit board 12, although such is not required.

Figure 5:
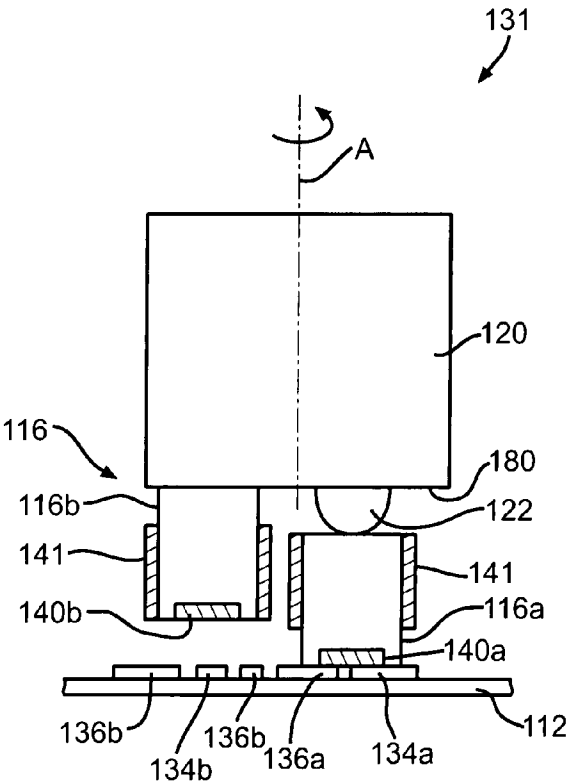
FIG. 5 is a schematic sectional view of an alternate embodiment of a switch apparatus in accordance with the present invention.

Referring now to FIG. 5, a second embodiment of the switch apparatus 131 is schematically illustrated. The switch apparatus 131 is similar to the switch apparatus 31 and generally only the components that differ will be described herein. Many of the components of the first embodiment of the switch apparatus 31 as illustrated in FIGS. 1 through 4 are similar in structure and function to corresponding components of the second embodiment of the switch apparatus 131 as illustrated in FIG. 5. Therefore, such corresponding components are indicated by similar reference number in these Figures, but with the components of the second embodiment of the switch apparatus 131 having the addition of 100 to each reference number.

The switch apparatus 131 includes a knob 120 having a cam 122 extending therefrom. Unlike the cam 22, the cam 122 does not extend from an outer peripheral edge of the knob 120, instead the cam 122 extends from a bottom portion 180 of the knob 120 that is not a peripheral edge of the knob 120. The cam 122 may engage the first switch 116*a* and the first switch 116*b* of the at least one switch 116, depending on the rotational movement of the knob 120 about the axis A. As illustrated, the cam 122 is engaging the first switch 116*a*, such that the first switch 116*a* is in an engaged position in which a switch contact 140*a* of the first switch 116*a* is electrically connecting a first contact 134*a* to a second contact 136*b*. The cam 122 is disengaged from the second switch 116*b*, and the second switch 116*b* remains in a disengaged position in which the switch contact 140*b* of the second switch 116*b* is spaced apart from at least one of a switch contact 134*b* and a switch contact 136*b*. However, it will be appreciated that the knob 120 may be rotated about the axis A such that the cam 122 engaged the second switch 116*b* to move the second switch 116*b* into an engaged position, similar to the engaged position of the first switch 116*a*.

The switch 116*a* and switch 116*b* at least one switch 116 are each mounted to a respective switch housing 141. Each of the at least one switch 116 may be any conventional switch with a linearly actuated switch contact, and is not limited to dome or membrane switches. It will also be appreciated that an elastomeric pad is required for the invention. Each of the at least one switch 116 may be biased such that each of the at least one switch 116 is urged away from the circuit board 112 and the respective first contact 134 and/or second contact 136. The engagement of the cam 122 against one of the at least one switch 116 may overcome this bias to move the at least one switch 116 into contact with the respective first contact 134 and/or second contact 136.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A vehicle switch apparatus comprising:

a circuit board comprising a plurality of circuits, each of the plurality of circuits having a first contact and a second contact;

a knob rotatably mounted relative to the circuit board, the knob having at least one cam extending therefrom; and a plurality of switches, each of the plurality of switches corresponding respectively to one of the plurality of circuits, each of the plurality of switches having a switch contact, the switch contact linearly movable to an engaged position in which the switch contact contacts the first contact and the second contact of the respective circuit, such that the first contact and the second contact are electrically connected;

wherein the knob has a plurality of detents aligning the knob in a plurality of positions relative to the circuit board, such that when the knob is rotated to one of the plurality of positions the at least one cam is positioned to move one of the switch contacts of the plurality of switches into the engaged position.

2. The apparatus according to claim 1, further comprising an elastomeric pad, wherein each of the plurality of switches comprises at least one dome switch extending from the elastomeric pad, each of the dome switches having a contact dome comprising the switch contact.

3. The apparatus according to claim 2, wherein at least a portion of the elastomeric pad is translucent.

4. The apparatus according to claim 2, wherein the elastomeric pad includes a layer of elastomer that is translucent.

5. The apparatus according to claim 2, wherein at least a portion of the elastomeric pad filters light.

6. The apparatus according to claim 2, wherein the elastomeric pad may include at least one dome switch actuated by a push button.

7. The apparatus according to claim 2, further comprising a bezel having a mounting apparatus, wherein the at least one knob is rotatably mounted to the bezel.

8. The apparatus according to claim 7, wherein at least one transfer pin is disposed between the at least one dome switch and the bezel, and extending from the bezel, such that the cam engages the transfer pin to move the contact dome to the engaged position.

9. The apparatus according to claim 8, wherein the at least one transfer pin is a detent to position the knob relative to the bezel.

10. The apparatus according to claim 2, wherein at least one transfer pin is molded integral to elastomer such that the at least one cam engages the at least one transfer pin to move the contact dome to the engaged position.

11. The apparatus according to claim 1, wherein the knob includes at least one detent to position the knob relative to the bezel.

12. The apparatus according to claim 1, wherein each of the switch contacts is linearly movable from the engaged position to a disengaged position in which the switch contact is spaced apart from the first contact and the second contact of the respective circuit.

13. The apparatus according to claim 12, wherein each of the switch contacts remains in the disengaged position until the at least one cam moves the at least one switch contact into the engaged position.

14. The apparatus according to claim 1, wherein the at least one cam is comprised of a single cam, such that the single cam moves one switch contact of the plurality of switches into the engaged position while the other switch contacts of the plurality of switches are not moved into the engaged position.

15. The apparatus according to claim 1, wherein the at least one cam is comprised of a single cam, the single cam moving one switch contact of the plurality of switches into the engaged position before releasing another switch contact of the plurality of switches from the engaged position.

16. The apparatus according to claim 1, wherein the at least one cam is comprised of a plurality of cams, such that one of the plurality of cams moves one switch contact of the plurality of switches into the engaged position while the other switch contacts of the plurality of switches are not moved into the engaged position.

17. The apparatus according to claim 1, wherein the at least one cam is comprised of a plurality of cams, such that one of the plurality of cams moves one switch contact of the plurality of switches into the engaged position before releasing another switch contact of the plurality of switches from the engaged position.

18. A vehicle switch apparatus comprising:

a circuit board comprising a plurality of circuits, each of the plurality of circuits having a first contact and a second contact;

an elastomeric pad including a plurality of dome switches extending outwardly therefrom, each of the plurality of dome switches corresponding to a respective one of the plurality of circuits, the plurality of dome switches each having a switch contact, each of the switch contacts linearly movable to an engaged position in which each of the switch contacts engages the first contact and the second contact of the respective circuit, such that the first contact and the second contact are electrically connected, and from a disengaged position in which the switch contact is spaced apart from at least one of the first contact and the second contact of the respective circuit;

a bezel having a mounting apparatus; and a knob rotatably mounted to the bezel, the knob having a plurality of cams extending therefrom, each of the plurality of cams corresponding to a respective one of the plurality of circuits, the knob rotatably movable such that one of the plurality of cams moves one of the plurality of switch contacts into the engaged position while the other of the plurality of switch contacts remains in the disengaged position.

19. A vehicle switch apparatus comprising:

a circuit board comprising at least one circuit having a first contact and a second contact;

a knob rotatably mounted relative to the circuit board, the knob having a plurality of cams extending therefrom; and at least one switch corresponding respectively to the at least one circuit, at elast one switch having a switch contact, the switch contact linearly movable to an engaged position in which the switch contact contacts the first contact and the second contact of the respective at least one circuit, such that the first contact and the second contact are electrically connected;

wherein the knob is rotatably movable such that one of the plurality of cams moves one switch contact of the plurality of switches into the engaged position before releasing another switch contact of the plurality of switches from the engaged position.

* * * * *